United States Patent [19]

Becker

[11] 4,341,836

[45] Jul. 27, 1982

[54] SURFACING FOR SPORTS AREAS, MORE PARTICULARLY TENNIS COURTS

[76] Inventor: Heinz Becker, Gottfried-Keller-Str. 2, 6204 Taunusstein 1, Fed. Rep. of Germany

[21] Appl. No.: 189,588

[22] Filed: Sep. 23, 1980

Related U.S. Application Data

[63] Continuation of Ser. No. 2,400, Jan. 10, 1979, abandoned.

[30] Foreign Application Priority Data

Jun. 15, 1978 [DE] Fed. Rep. of Germany ..... 2826206

[51] Int. Cl.[3] ..... B32B 5/16

[52] U.S. Cl. ..... 428/308.4; 273/29 R; 273/DIG. 13; 427/201; 427/203; 428/327; 428/334; 428/423.9; 428/424.7

[58] Field of Search ..... 428/17, 327, 323, 334, 428/304, 306, 425, 492, 493, 494, 308.4, 423.9, 424.7; 273/29 R, DIG. 13; 427/201, 203

[56] References Cited

U.S. PATENT DOCUMENTS 3,801,421 4/1974 Allen ..... 428/17

*Primary Examiner*—Marion McCamish

*Attorney, Agent, or Firm*—Gifford, Van Ophem, Sheridan & Sprinkle

[57] ABSTRACT

The invention relates to a surfacing for sports areas, more particularly tennis courts in which a bearing layer (2,2*a*) is applied to a surface (1) , fragments are then secured by means of the said bearing layer (2,2*a*) and arranged to leave voids and a top covering (4) of fine grains is applied. A process for preparing the surfacing may comprise a curable liquid resin that is cast as the bearing layer up to a thickness of about three to four millimeters on the surface and raked off. Fragments are about two-thirds embedded in the bearing layer and after curing a covering layer of fine grains is applied.

11 Claims, 4 Drawing Figures

SURFACING FOR SPORTS AREAS, MORE PARTICULARLY TENNIS COURTS

CROSS REFERENCE TO RELATED APPLICATIONS

This is a continuation, of application Ser. No. 002,400, filed Jan. 10, 1979 now abandoned.

BACKGROUND OF THE INVENTION

I. Field of the Invention

The invention relates to a surfacing for sports areas, more particularly tennis courts.

II. Description of the Prior Art

Surfacings of rubber or plastic as well as a very wide variety of surfacings, e.g. brick dust for tennis courts, can of course be used for sports areas of this kind. For instance, it is known to apply a layer of tire rubber fragments bonded by polyurethane to a base surface consisting of asphalt or concrete or timber. It is also known to use 100% polyurethane coatings, e.g. on asphalt surfaces. Surfacings of this kind have a number of advantages over conventional surfacings, such as reduced maintenance; unfortunately, they are not entirely satisfactory physiologically. They are non-slip consequently, for instance, tennis players cannot slide to a stop when they are moving and instead, because of the non-slip nature of the surfacing, they stop relatively abruptly, with the result that their joints in particular are severely overstressed.

SUMMARY OF THE INVENTION

According to the present invention I provide a surfacing for sports areas, more particularly tennis courts, characterised by: a bearing layer applied to a surface; fragments secured by means of the bearing layer and arranged to leave voids; and a top covering layer of fine grains.

Advantageously, the fragments are made of rubber or plastics.

Advantageously, the fragments are approximately two-thirds embedded in the bearing layer; in this event the fragments have a mesh size of approximately three to four millimeters.

Conveniently, the fine grains of the covering layer have a mesh size of from one to three millimeters; preferably, the grains consist of rubber but can be of some other material.

If the novel coating is also required to have extra resistance in respect of weather factors, such as rain or the like, a pervious combined fixing and bearing layer secures fragments to the surface; a layer of very fine particles is applied to the covered fragments; and the covering layer which contains fine grains and which fills up the voids between the tops of the covered fragments is provided above the layer of very fine particles.

Because of its composition, this modified version of a sports area according to the invention is highly water-repellent as well as having optimum physiological properties; the surfacing is, therefore, ready for play very rapidly after rain.

As an advantageous development of the invention, a resilient intermediate layer can be placed below the actual surfacing. Since the intermediate layer is also water-permeable, the complete surfacing retains its good drainage properties. Advantageously, the intermediate layer can take the form of polyurethane-bonded rubber fragments.

Advantageously, the permeable securing layer can take the form of an air-curing plastics such as polyurethane. The embedded fragments can be of rubber or plastic; preferably, they have a mesh size of from three to four millimeters.

Preferably, the fine grains of the covering layer have a mesh size of approximately one to three millimeters. Preferably, the material used for the fine grains is rubber but it can be some other material.

Preferably, very fine rubber particles having a grain size of approximately from 0.1 to 0.5 mm are used as the elements for adjusting the coefficient of friction of the surfacing and are applied to the fragments coated with the securing layer.

The invention also discloses a process for preparing each form of surfacing. In the process for one variant, a curable liquid resin is cast as bearing layer up to a thickness of approximately three to four millimeters on the surface and raked off; fragments are approximately two-thirds embedded in the curing bearing layer; and after curing thereof a covering layer of fine grains is applied. In another process for preparing a variant, a composition consisting of a curable liquid resin and of fragments is applied to the surface and forms (after curing of the plastic) a thin layer which at least partly covers the fragments, secures the same to the surface and leaves voids between them; very fine particles adapted for sticking are applied to the fragments covered by the thin layer; and after curing of the fragment-securing layer a covering layer containing fine grains is applied.

In an advantageous development of the latter process, the composition consisting of plastic and fragments is applied by spraying. The securing or fixing layer can therefore be thin enough to rupture or break between the fragments and leave voids, since the sprayed film cannot cover the unevennesses between the fragments. Water on the surfacing can drain away rapidly through the voids and possibly through the intermediate layer as well.

BRIEF DESCRIPTION OF THE DRAWINGS

Some preferred embodiments of the invention will now be described in greater detail with reference to the figures of the accompanying drawing in which.

DESCRIPTION OF THE PREFERRED EMBODIMENT

Figure 1:
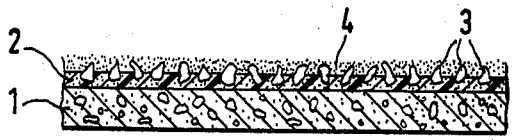
FIG. 1 is a section through a first embodiment of a part of a surfacing.

In FIG. 1, the surfacing is for a sports area, more particularly a tennis court; it covers a prepared base surface 1 which consists for example of asphalt but can be formed from concrete or timber or other materials. A bearing layer 2 which in known manner can consist of polyurethane-bonded rubber fragments is applied to the base surface 1. Disposed on bearing layer 2 are a number of fragments 3 which consist of a rubber or plastic material. The fragments 3 are embedded in the bearing layer 2 so as to be approximately two-thirds embedded therein, the top third of the fragments projecting from the bearing layer 2. Consequently, a large number of voids are left between the fragments 3 and these are filled by a covering layer 4 which can, if required, also cover the top tips of the partly embedded fragments 3. The covering layer 4 consists of fine grains, preferably also of a rubber material, although other material, such as inter alia conventional brick dust, can be used.

Conveniently, fragments 3 approximately three or four millimeters thick are pressed into the bearing layer 2, the size of the fragments 3 corresponding to a mesh aperture of three to four millimeters. Preferably, a granulate having a mesh size of from one to three millimeters is used for the fine grains forming the covering layer 4.

Clearly, the various materials can be adapted to one another or be given different colorings.

Figure 2:
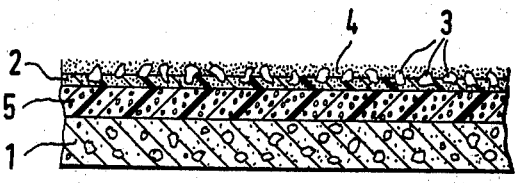
FIG. 2 is a section through a variant of the surfacing of FIG. 1 showing a resilient intermediate layer.

In FIG. 2, an intermediate layer 5 consisting of polyurethane-bonded rubber fragments is first applied to the base surface 1 in a manner known in the production of floor coverings. The purpose of the intermediate layer 5 is to impart resilience to the complete end product. A covering or coating similar to that described for FIG. 1 is then applied to the intermediate layer 5—i.e. a bearing layer 2 is provided which contains fragments 3 and voids that are filled up by the covering layer 4 to the tops of the fragments 3.

When the sole of a player's shoe is pressed on the surface, the tips of the fragments 3 contact the sole and offer sufficient resistance and grip to give said player a satisfactory starting push-off.

When an athlete for example wishes to slow down, the covering layer 4 of fine grains enables him to do so by sliding or slipping, more particularly because the sliding or slipping proceeds horizontally on the covering layer 4 and because the tips of the fragments 3 consist of a resilient rubber-like material.

One of the advantages of the surfacing described is, therefore, that it requires little maintenance and only occasional cleaning. It can also be used for athletics in the spring and autumn so that the official season can be extended considerably. Another advantage revealed by tests is that it causes less wear of tennis balls and footgear. However, the surfacing combines these advantages in a completely novel manner with optimum physiological properties because it enables the athlete to have a very good starting push-off but enables him to slow down by sliding or slipping on the surface, thus reducing stressing of the athlete's joints.

In a process for the preparation of the surfacing shown in FIG. 1, a curable liquid plastic such as polyurethane is cast as bearing layer 2 up to a thickness of three to four millimeters on the base surface 1, then raked off. The fragments 3 are then so pressed into the now curing layer 2 as to be approximately two-thirds embedded in the bearing layer 2. The pressing-in is done preferably by means of a flat screen enabling the tops of the fragments 3 to escape and subsequently project above the layer 2. A covering layer 4 of fine grains is then applied to fill the voids left between the projecting tops of the fragments 3, the fill extending approximately to the top tips of the fragments 3 and possibly slightly covering the tips thereof. In this application the fine grains are thrown on and swept with a broom so as to be uniformly distributed. In a further development of the process, to provide particular resilient properties in accordance with FIG. 2, a resilient intermediate layer 5 can first be applied to the base surface 1, followed, in the manner previously described, by a bearing layer 2 with fragments 3, then by the covering layer 4.

Figure 3:
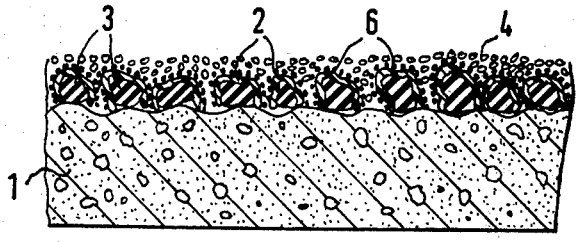
FIG. 3 is a section through a second embodiment of a surfacing showing the polyurethane layer coated on the fragments.

The surfacing shown in FIG. 3 has similar playing properties to the surfacing of FIG. 1 but also has good drainage properties. A composition consisting preferably of air-curing polyurethane and small rubber fragments 3 of a mesh size of e.g. from three to four millimeters is sprayed on to a base surface 1 formed e.g. by a previous conventional surfacing. The polyurethane cures the fragments 3 into a thin securing or fixing layer 2 which secures or fixes the fragments 3 to the surface 1 below. The layer 2 is so thin as to rupture between the fragments 3 and leave voids, since the fragment side walls and the unevennesses below form a relatively large surface area which is too large for the sprayed film. The inherently water-impervious polyurethane layer therefore becomes water-pervious.

An adhesion booster 6 applied to the layer 2 gives some grip to the smooth surface of the layer 2. In the embodiment of FIG. 3, the element 6 takes the form of very fine rubber particles having a grain size of from approximately 0.1 to 0.5 mm, the particles being secured to the surface of the layer 2 to improve the adhesion of the subsequently applied covering layer. An adhesion booster of this kind is commercially available e.g. under the name of "Baruthan".

The relatively large voids between the fragments 3 embedded in the layer 2 are filled up by a covering layer consisting preferably of rubber fragments or grains having a grain size of from 0.5 to 1.5 mm. Alternately, a covering layer 4 of conventional brick dust or the like can be used. The layer 4 is porous—i.e. water-permeable.

The surfacing of FIG. 3 can be given any coloring, provides an optimum compromise between adhesion and sliding for the athlete's foot because of the rubbery tips of the fragments 3, causes very little wear of footgear and balls and reduces the strain on the athlete's joints. Also because of the voids in the layer 2, rainwater drains away very rapidly.

Figure 4:
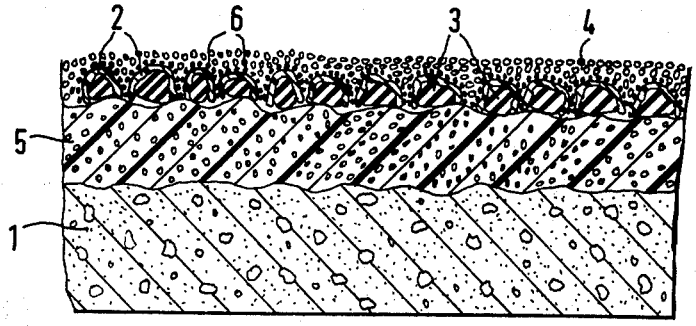
FIG. 4 is a section through a variant of the surfacing shown in FIG. 3.

FIG. 4 shows a variant of the surfacing of FIG. 3 wherein the same water-pervious fully resilient intermediate layer 5 consisting of polyurethane-bonded rubber fragments as is used in FIG. 2 is placed below the surfacing. The intermediate layer 5 improves the overall resilience of the surfacing above it but does not impair drainage.

To produce the surfacing of FIG. 3, a composition consisting of a curable liquid plastic, such as polyurethane, in which fragments having a mesh size of approximately three or four millimeters are embedded, is sprayed up to a thickness of three or four millimeters on the prepared surface. The cured plastic forms the layer 2 which bonds the fragments 3 to the surface 1 or 5 below. The fragments 3, covered by the layer 2 in which there are voids and which is, therefore, water-pervious, are then covered with the very fine adhesion-boosting particles 6—i.e. the same are secured to the surface of the layer 2—whereafter the fine-grain covering layer 4 is introduced into the voids between the tops of the fragments 3 approximately as far as the region of the top tips thereof and possibly even covering such tips. The layer 4 can be applied e.g. by being distributed uniformly by means of a broom.

In a further development of the process, shown in FIG. 4, to give the surfacing of FIG. 3 particular properties of resilience, a resilient pervious intermediate layer 5 can first be applied to the surface of the base 1, then covered with the surfacing proper as hereinbefore described.

I claim:

1. A surfacing for sports areas comprising:

a polyurethane bearing layer applied to a surface;

resilient rubber fragments embedded substantially two-thirds within the bearing surface at spaced locations relative to each other thus forming voids therebetween, the depth of said voids being about one-third or more of the size of said fragments; and a top covering layer of fine rubber grains substantially entirely filling the voids.

2. The surfacing according to claim 1, wherein:

said bearing layer secures fragments to the surface;

a layer of very fine adhesion particles is applied to the covered fragments;

and the covering layer which contains fine grains and which fills up the voids between the tops of the covered fragments is provided above the layer of very fine particles.

3. The surfacing according to claim 2, wherein the polyurethane tears during curing so as to be pervious.

4. The surfacing according to claim 1 wherein the fragments have a mesh size of approximately three to four millimeters.

5. The surfacing according to claim 1 wherein the fine grains of the covering layer have a mesh size of approximately one to three millimeters.

6. The surfacing according to claim 1, and further comprising a resilient intermediate layer applied to said surface below said bearing layer.

7. The surfacing according to claim 6, wherein said intermediate layer has a coarse structure and is water-permeable.

8. A process for preparing a surface comprising the steps of:

casting a curable liquid polyurethane on a base surface up to a thickness of approximately three to four millimeters;

embedding rubber fragments approximately two thirds of the length of the fragments in the liquid polyurethane;

curing said polyurethane layer with rubber fragments therein so as to form a bearing layer; and applying a covering layer of rubber fine grains.

9. The invention as defined in claim 8 wherein said fragments are pressed into the liquid polyurethane by flat screen means such that the tops of said fragments project above the bearing layer when the polyurethane cures.

10. A process for preparing a surfacing comprising the steps of:

applying a mixture of curable liquid polyurethane and resilient rubber fragments to a base surface so as to form, upon curing of the polyurethane, a bearing layer having substantially one-third of the fragments projecting upwardly from top surface with voids between said fragments; and applying a covering layer of rubber fine grains to said bearing layer so as to fill the voids between said fragments.

11. The process according to claim 10 wherein said mixture is applied by spraying.

* * * * *